United States Patent [19]

Watkins

[11] Patent Number: 4,822,118

[45] Date of Patent: Apr. 18, 1989

[54] ROTATING PASTEL STORAGE TABOURET

[76] Inventor: James A. Watkins, 27 Brier Springs, Conway, Ark. 72032

[21] Appl. No.: 152,560

[22] Filed: Feb. 5, 1988

[51] Int. Cl.[4] ..... A47B 88/00

[52] U.S. Cl. ..... 312/244; 312/252; 312/305; 312/284; 312/309; 211/131

[58] Field of Search ..... 312/244, 252, 125, 135, 312/305, 11, 284, 309, 202; 211/165, 163, 77, 78, 129, 131

[56] References Cited

U.S. PATENT DOCUMENTS

| | | | |
|---|---|---|---|
| D. 215,766 | 10/1969 | Dusek . | |
| D. 237,171 | 10/1975 | Norman . | |
| D. 264,096 | 4/1982 | Jones . | |
| D. 265,915 | 8/1982 | Tivey . | |
| 310,784 | 1/1885 | Bollinger | 211/131 X |
| 571,717 | 11/1896 | Ballard | 312/252 X |
| 763,291 | 6/1904 | Klayman | 312/125 |
| 931,960 | 8/1909 | Robinson | 211/129 |
| 2,749,198 | 6/1956 | Berber | 312/252 |
| 3,227,283 | 1/1966 | Ahlman | 211/163 X |
| 3,945,490 | 3/1976 | Thompson . | |
| 4,216,867 | 8/1980 | Sturm | 211/77 |
| 4,744,613 | 5/1988 | Brantingham et al. | 312/244 |

*Primary Examiner*—Joseph Falk

*Attorney, Agent, or Firm*—Jerry T. Kearns

[57] ABSTRACT

A rotating pastel storage tabouret has a pyramidal compartmentalized storage tray for storing and organizing pastels. The storage tray is rotatably mounted on a supporting base. In a second embodiment, the storage tray is provided with a plurality of grooves for holding the pastels and a mechanism for adjusting the angle of the storage compartments. A removable lid having a sponge rubber lining is secured to the tabouret by a plurality of spaced resilient clips. In use, the rotating tabouret serves to organize and safely store a large number of artist's pastels.

2 Claims, 3 Drawing Sheets

ROTATING PASTEL STORAGE TABOURET

BACKGROUND OF THE INVENTION

1. Field of the Invention

The present invention relates to art storage devices, and more particularly pertains to a rotating pastel storage tabouret which provides pastel artists with a device whereby they can place their pastels on a slanted surface in color groups, for example, reds, blues, yellows, greens, etc. The artist can rotate the tabouret, bringing each group of pastels within easy grasp for selection and use, and orderly return the pastels to their appropriate color area after usage. A top central tray compartment allows pastels in immediate use to be retained to preclude having to hold them together in the hand. One of the most difficult and frustrating problems a pastel artist faces is in maintaining some order within the pastels' color groups while working on a painting. Pastels have many gradations of tints and shades. Pastel artists waste a considerable amount of time and become frustrated searching for a particular pastel stick with other available storage devices. Art storage devices now available on the market are of the simple bin-type with slotted boxes for each pastel stick. The individual pastel sticks are difficult to retrieve and require too much concentration when returning them to their exact bin, rather than being able to spend more time concentrating on the painting. Some artists use a flat surface stationary palette on which they keep their pastels. This soon becomes a jumbled conglomerate of mixed up pastel sticks and it soon becomes very difficult to select wanted colors. The present invention solves these problems by grouping pastels by color groups on a slanted rotatable surface which is easily accessible to the artist. The storage tray of the rotating tabouret of the present invention is divided into sixteen compartments for organizing sixteen-pastel color groups.

2. Description of the Prior Art

Various types of art storage devices are known in the prior art. A typical example of such an art storage device is to be found in U.S. Pat. No. Des. 215,766, which issued to R. Dusek on Oct. 28, 1969. This patent discloses a circular paint storage box having a removable lid with an attached handle. The storage box is provided with a central circular recess and a plurality of peripheral storage recesses. U.S. Pat. No. Des. 237,171, which issued to F. Norman on Oct. 14, 1975, discloses an artist's palette provided with a plurality of circular storage recesses. U.S. Pat. No. Des. 264,096, which issued to J. Jones on Apr. 27, 1982, discloses a generally rectangular art palette having a plurality of peripheral storage recesses and a removable cover. U.S. Pat. No. Des. 265,915, which issued to M. Tivey on Aug. 24, 1982, discloses a water color palette having a generally oval configuration which is provided with a plurality of circular storage recesses of varying demensions. U.S. Pat. No. 3,945,490, which issued to V. Thompson on Mar. 23, 1976, discloses an artist's palette which utilizes a pad of disposable sheets of material for mixing paints. The palette has a removable cover which holds the palette pad in place and a cap for sealing a handle recess in the palette. The palette is designed to be easily stacked or carried about by the artist.

While the above mentioned devices are suited for their intended usage, none of these devices provide a rotating tabouret having a pyramidal compartmentalized storage tray for storing pastels by color groups.

Additionally, none of the aforesaid art storage devices utilizes a pyramidal cover lined with sponge rubber and provided with resilient clips for engagement with a pyramidal compartmentalized storage tray. Inasmuch as the art is relatively crowded with respect to these various types of art storage devices, it can be appreciated that there is a continuing need for and interest in improvements to such art storage devices, and in this respect, the present invention addresses this need and interest.

SUMMARY OF THE INVENTION

In view of the foregoing disadvantages inherent in the known types of art storage devices now present in the prior art, the present invention provides an improved rotating pastel storage tabouret. As such, the general purpose of the present invention, which will be described subsequently in greater detail, is to provide a new and improved rotating pastel storage tabouret which has all the advantages of the prior art storage devices and none of the disadvantages.

To attain this, representative embodiments of the concepts of the present invention are illustrated in the drawings and make use of a pyramidal compartmentalized storage tray for storing and organizing pastels. The storage tray is rotatably mounted on a supporting base. In a second embodiment, the storage tray is provided with a plurality of grooves for holding the pastels and a mechanism for adjusting the angle of the storage compartments. A removable lid having a sponge rubber lining is secured to the tabouret by a plurality of spaced resilient clips. In use, the rotating tabouret serves to organize and safely store a large number of artist's pastels.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotating pastel storage tabouret which has all the advantages of the prior art storage devices and none of the disadvantages.

It is another object of the present invention to provide a new and improved rotating pastel storage tabouret which may be easily and efficiently manufactured and marketed.

It is a further object of the present invention to provide a new and improved rotating pastel storage tabouret which is of a durable and reliable construction.

An even further object of the present invention is to provide a new and improved rotating pastel storage tabouret which is susceptible of a low cost of manufacture with regard to both materials and labor, and which accordingly is then susceptible of low prices of sale to the consuming public, thereby making such art storage devices economically available to the buying public.

Still yet another object of the present invention is to provide a new and improved rotating pastel storage tabouret which provides in the apparatuses and methods of the prior art some of the advantages thereof, while simultaneously overcoming some of the disadvantages normally associated therewith.

Still another object of the present invention is to provide a new and improved rotating pastel storage tabouret which provides a pyramidal compartmentalized storage tray for organizing pastel sticks by color groups.

Yet another object of the present invention is to provide a new and improved rotating pastel storage tabouret having a pyramidal compartmentalized storage tray provided with a removable pyramidal cover lined with a sponge rubber material for allowing the safe storage and transport of pastel sticks.

Even still another object of the present invention is to provide a new and improved rotating pastel storage tabouret for storing pastel sticks by color groups on a slanted surface within easy grasp for selection, use and orderly return by an artist.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
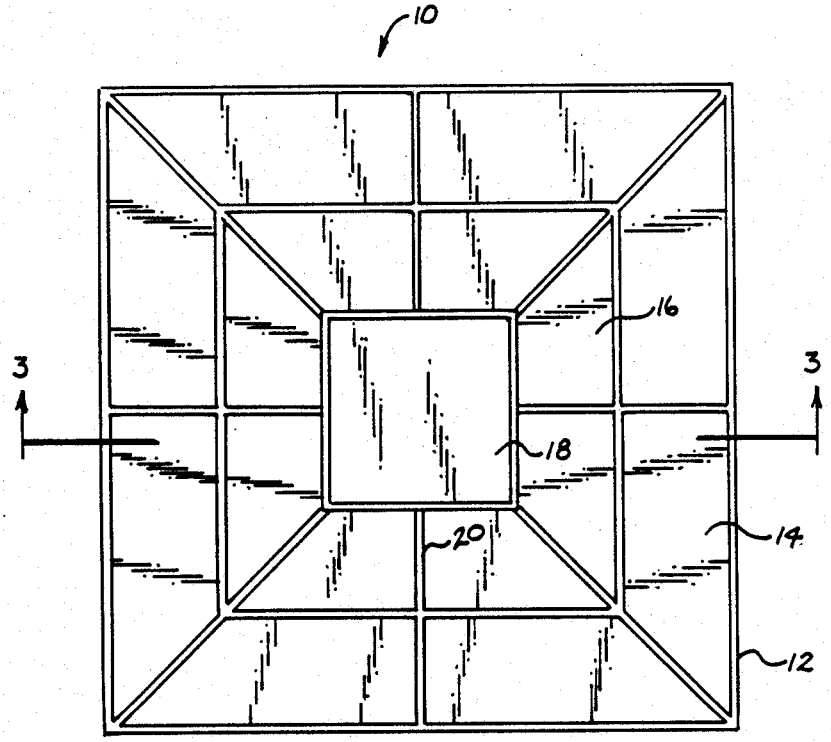
FIG. 1 is a top view of a rotating pastel storage tabouret according to a first embodiment of the present invention.

With reference now to the drawings, and in particular to FIG. 1 thereof, a new and improved rotating pastel storage tabouret embodying the principles and concepts of the present invention and generally designated by the reference numeral 10 will be described.

More specifically, it will be noted that the first embodiment 10 of the invention includes a pyramidal storage tray 12 divided into a plurality of compartments 14 and 16 by inclined vertical upstanding dividers 20.

Figure 2:
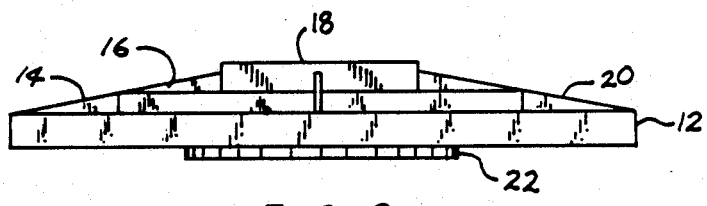
FIG. 2 is a side view of a rotating pastel storage tabouret according to the first embodiment of the present invention.

In FIG. 2, a side view of the first embodiment of a rotating tabouret 10 is provided. A circular base plate 22 rotatably mounts the storage tray 12. A square central storage compartment 18 having a flat level floor is formed by four upstanding side walls adjacent a central portion of the tray 12.

Figure 3:
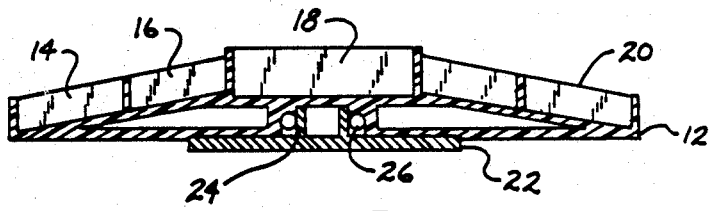
FIG. 3 is a transverse cross sectional view, taken along line 3—3 of FIG. 1.

As shown in FIG. 3, the tray 12 has four downwardly outwardly slanted sides which form a three to five degree angle with the floor of the central compartment 18. Each of the four inclined sides of the tray 12 is divided into four compartments 14 and 16 by a plurality of upstanding dividers 20. A circular base 22 has a flat bottom surface for resting on a table or other flat surface. The base 22 has a central upstanding cylindrical hub 24 provided with a caged ball bearing assembly 26. The ball bearing assembly 26 is received within a central circular recess on the bottom surface of the tray 12. Thus, the tray 12 is mounted for rotation on the base 22. In use, pastel sticks will be organized by color groups in the sixteen compartments 14 and 16. Pastel sticks currently in use may be stored in the central compartment 18. The inclined sides of the compartment 18 allow an artist to readily select a desired pastel. By rotating the tray 12, various color groups may be moved into position within arm's reach of an artist.

Figure 4:
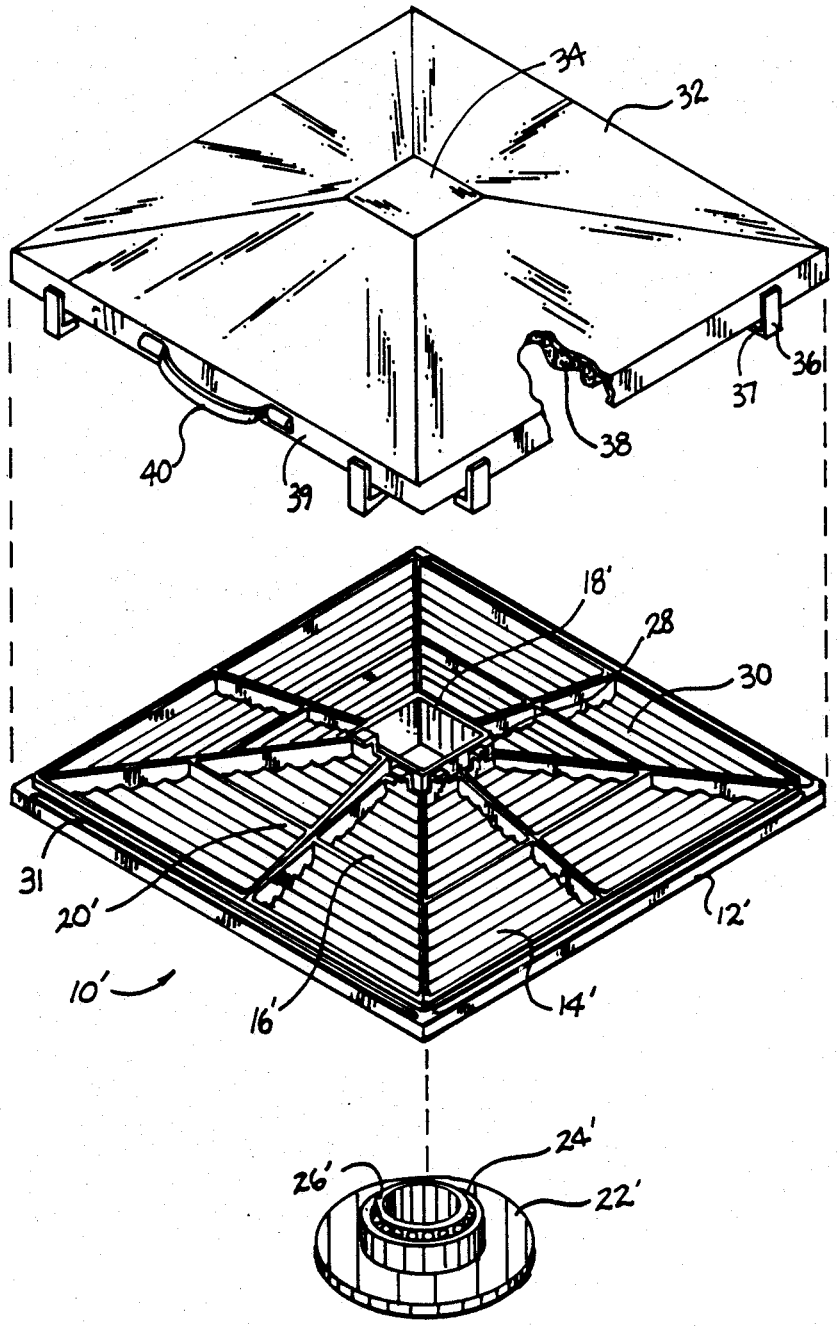
FIG. 4 is a perspective view of a rotating pastel storage tabouret according to a second embodiment of the present invention.

In FIG. 4, an exploded perspective view of a rotating tabouret according to a second embodiment 10' of the present invention is provided. A pyramidal storage tray 12' has a plurality of quadrilateral individual compartments 14' and 16'. Each of the compartments 14' has a secondary compartment 16' formed by vertical upstanding dividers 20'. A peripheral groove 31 extends along each side of the tray 12' for storage of pastel sticks currently in use. A square central storage compartment 18' is formed by four vertical upstanding side walls at a central portion of the tray 12'. Each of the compartments 14' is provided with a tab 28 to facilitate angular adjustment. Each of the compartments 14' is provided with a plurality of adjacent grooves 30 for the storage of individual pastel sticks. The tray 12' is mounted on a circular base plate 22' having a central cylindrical upstanding hub 24' with a caged ball bearing assembly 26'. A removable pyramidal cover 32 has a central flat square surface 34 surrounded by four downwardly inclined sides. Each of the inclined sides is connected to a vertical peripheral rim 39 around which a plurality of "L"-shaped latches 36 are spaced. Each of the latches 36 has a bottom leg 37 for engagement with a bottom surface of the tray 12'. The latches 36 are formed from a resilient plastic material and thus may be manipulated into and out of engagement with the tray 12'. The cover 32 is provided with a sponge rubber lining 38 to protect pastel sticks stored in the tray 12'. A handle 40 on the vertical peripheral rim 39 allows the tray 12' to be conveniently transported.

Figure 5:
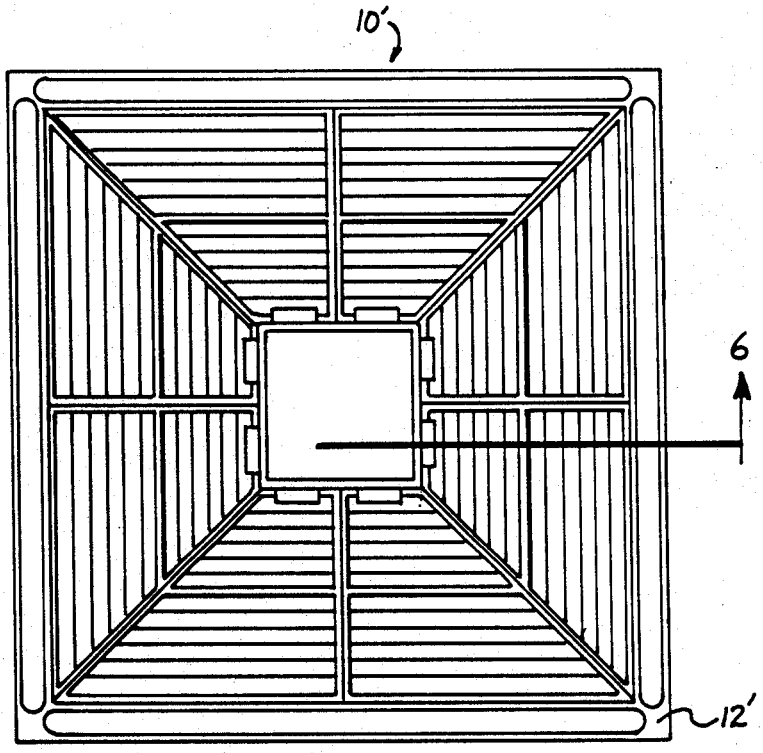
FIG. 5 is a top view of a rotating pastel storage tabouret according to the second embodiment of the present invention.

In FIG. 5, a top view of the rotating tabouret of the second embodiment 10' of the present invention is provided.

Figure 6:
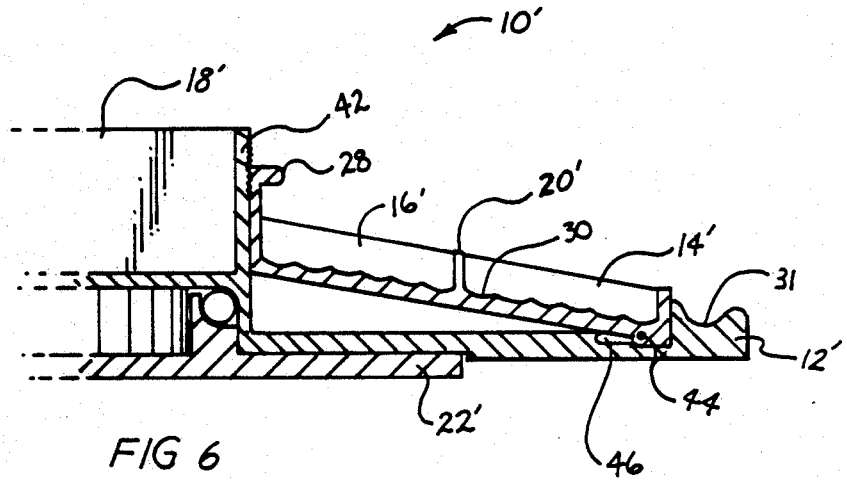
FIG. 6 is a transverse cross sectional view taken along line 6 of FIG. 5.

In FIG. 6, a partial transverse cross section is provided, which illustrates the angular adjustment mechanism of the individual compartments 14'. A plurality of horizontal serrations 42 are provided on the outer surface of each of the upstanding vertical side walls of the square central compartment 18'. These serrations cooperate with serrations on an outer top wall surface of each of the individual compartments 14'. The compartments 14' are formed from a resilient plastic material which is slightly deformable by manipulation of a tab 28 for frictional engagement with the serrations 42. An outer bottom portion of each of the compartments 14' is pivotally mounted on the tray 12' by virtue of pivotal and sliding engagement of a pin 44 in a slot 46. This allows the inclination of the compartments 14' to be selectively adjusted by a user. This feature is useful in distinguishing a color group of pastels currently in use from the other groups of pastels stored in the tray 12'. By manipulating the tab 28, the selected color group of pastels may be slightly elevated above the remaining pastels, thus enabling an artist to quickly locate a desired pastel stick.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved rotating pastel storage tabouret, comprising:

a circular base having a flat bottom end and upper surface with a raised central cylindrical hub;

a caged ball bearing on an upper end of said cylindrical hub;

a pyramidal storage tray having a flat bottom surface with a central circular recess;

said cylindrical hub received in said circular recess and mounting said storage tray for rotation;

said storage tray having a square central storage compartment with a flat level floor;

said storage tray having four planar sides slanted outwardly downwardly at a three to five degree angle with said flat level floor;

each of said planar sides having a plurality of inclined upstanding dividers forming four compartments;

a pyramidal cover having a flat level square central surface and four outwardly downwardly inclined sides terminating in a vertical peripheral rim;

a plurality of "L"-shaped latches formed from a resilient plastic material spaced around said vertical peripheral rim;

a sponge rubber lining on an inner surface of said pyramidal cover; and a handle on said vertical peripheral rim.

2. A new and improved rotating pastel storage tabouret, comprising:

a circular base having a flat bottom end and upper surface with a raised central cylindrical hub;

a caged ball bearing on an upper end of said cylindrical hub;

a pyramidal storage tray having a flat bottom surface with a central circular recess;

said cylindrical hub received in said circular recess and mounting said storage tray for rotation;

said storage tray having a square central storage compartment with a flat level floor;

said storage tray having four planar sides surrounding said central storage compartment;

a pair of quadrilateral storage trays divided into two compartments pivotally mounted on each of said planar sides;

said square central storage compartment having four upstanding side walls, each of said side walls having an outer surface provided with a plurality of parallel horizontal serrations;

each of said quadrilateral storage trays formed from a resilient plastic material and having an outer top wall surface provided with a plurality of serrations for selective engagement with said square central storage compartment serration;

a pyramidal cover having a flat level square central surface and four outwardly downwardly inclined sides terminating in a vertical peripheral rim;

a plurality of "L"-shaped latches formed from a resilient plastic material spaced around said vertical peripheral rim;

a sponge rubber lining on an inner surface of said pyramidal cover; and a handle on said vertical peripheral rim.

* * * * *